United States Patent [19]

Mori et al.

[11] 4,147,899

[45] Apr. 3, 1979

[54] BROADBAND ELECTROMAGNETIC SOUNDSOURCE WITH DIFFERENTLY TUNED DIAPHRAGMS

[75] Inventors: Shigeo Mori; Fumikazu Murakami; Yoshiaki Hara; Ichiro Horikoshi; Sohya Takahashi, all of Tokyo, Japan

[73] Assignee: Kabushiki Kaisha Daini Seikosha, Japan

[21] Appl. No.: 829,963

[22] Filed: Sep. 1, 1977

[30] Foreign Application Priority Data

Sep. 1, 1976 [JP] Japan ..... 51-104708

[51] Int. Cl.[2] ..... H04R 1/24; H04R 11/00

[52] U.S. Cl. ..... 179/116

[58] Field of Search ..... 179/179, 180, 184, 115 R, 179/115 A, 116

[56] References Cited

U.S. PATENT DOCUMENTS 2,791,641 5/1957 Pye ..... 179/179

FOREIGN PATENT DOCUMENTS 125645 5/1919 United Kingdom.

261231 11/1926 United Kingdom ..... 179/116

*Primary Examiner*—George G. Stellar

*Attorney, Agent, or Firm*—Robert E. Burns; Emmanuel J. Lobato; Bruce L. Adams

[57] ABSTRACT

An electroacoustic transducer particularly for small small-sized portable equipment such as a wristwatch comprises a first vibrating plate which is vibrated by means of an electromagnet and a second vibrating plate which is coupled with the first vibrating plate by an airtight space which acts as an air spring. The first and second vibrating plates have different natural resonant frequencies so that the vibration system comprising the two vibrating plates and the air spring coupling them with one another forms a vibration system having two resonant frequencies. A resonant air chamber superposed on the second vibrating plate has a sound radiating port and has a resonant frequency between the two resonant frequencies of the vibration system comprising the first and second vibrating plates and coupling air spring. The electroacoustic transducer thus responds to a considerable range of frequencies.

2 Claims, 10 Drawing Figures

BROADBAND ELECTROMAGNETIC SOUNDSOURCE WITH DIFFERENTLY TUNED DIAPHRAGMS

FIELD OF INVENTION

The present invention relates to electroacoustic transducers especially for small-sized portable equipment such as a wristwatch and is concerned with broadening the frequency band of the transducer.

BACKGROUND OF THE INVENTION

Electroacoustic transducers used as a sound source for small-sized portable equipment such as wristwatches, pocket watches and paging systems utilize resonance in order to reduce power consumption but this has a disadvantage that the transducer responds to only a narrow frequency band. Moreover, by reason of manufacturing tolerances, it is difficult to match the frequency of the electroacoustic transducer with the frequency of the energizing circuit.

SUMMARY OF THE INVENTION

It is an object of the present invention to broaden the frequency band of an electroacoustic transducer. In contrast with a conventional electroacoustic transducer having only one degree of freedom of mechanical vibration, the electroacoustic transducer of the present invention has two degrees of freedom of mechanical vibration and two mechanical resonance frequencies in order to broaden the frequency band by generating substantially constant acoustic pressure between the two mechanical resonance frequencies.

BRIEF DESCRIPTION OF DRAWINGS:

The nature, objects and advantages of the invention will be more fully understood from the following description in conjunction with the accompanying drawings in which.

DESCRIPTION OF PRIOR ART

Figure 1:
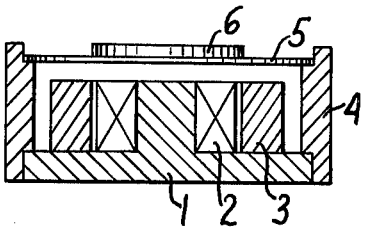
FIG. 1 PRIOR ART
FIG. 1 is a schematic sectional view showing by way of example a conventional electroacoustic transducer.
Figure 2:
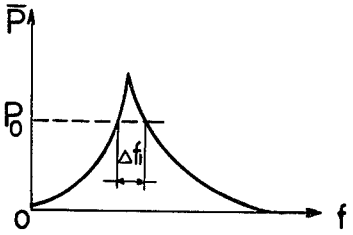
FIG. 2 PRIOR ART
FIG. 2 is a curve showing the drive frequency characteristics of the transducer of FIG. 1.

In FIG. 1 there is shown by way of example a conventional electroacoustic transducer comprising a magnetic core 1 with a center pole made of soft magnetic material, a coil 2 surrounding the center pole of the core 1, a permanent magnet 3 which surrounds the coil 2, a support 4 supporting a vibrating plate 5, and an armature 6 of soft magnetic material secured to the vibrating plate 5. When an alternating current is passed through the coil 2, attracting and repelling forces are alternately applied to the armature 6 to thereby vibrate the vibrating plate 5 to produce sound. This vibrating system fundamental has only one degree of freedom so that its acoustic pressure-drive frequency characteristic has a single resonance point as shown in FIG. 2 with the result that the frequency band $\Delta f_1$ producing a pressure higher than a predetermined acoustic pressure Po is quite narrow as illustrated in FIG. 2.

Figure 3:
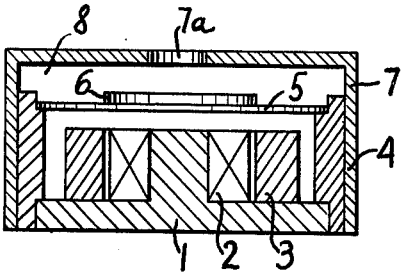
FIG. 3 PRIOR ART
FIG. 3 is a schematic sectional view showing another conventional electroacoustic transducer.
Figure 4:
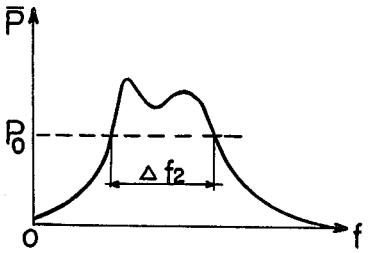
FIG. 4 PRIOR ART
FIG. 4 is a curve showing the drive frequency characteristics of the transducer of FIG. 3.

FIG. 3 is a schematic sectional view showing the structure of another conventional-type of electroacoustic transducer which broadens somewhat the frequency band. Components designated by reference numerals 1 to 6 are the same as those in FIG. 1. The electroacoustic transducer shown in FIG. 3 differs from that of FIG. 1 in that it has an acoustic case 7 with a sound radiating port 7*a* and a space 8 formed by the acoustic case 7 and the vibrating plate 5. The acoustic case 7, sound radiating port 7*a* and space 8 constitute in effect a Helmholtz resonator which provides the acoustic pressure-drive frequency characteristics shown in FIG. 4. It will be seen that the frequency band $\Delta f_2$ of the transducer shown in FIG. 3 is wider than the frequency band $\Delta f_1$ obtained by the transducer shown in FIG. 1. The electroacoustic transducer of the structure shown in FIG. 3 is sufficient to be used for one drive frequency within manufacturing tolerances but the structure does not satisfy the requirements in case sounds of different frequency are to be produced, for example sounds differing in frequency by one-half to one octave.

DESCRIPTION OF PREFERRED EMBODIMENT

The primary object of the present invention is to provide an electroacoustic transducer which will respond to a broad frequency band. The electroacoustic transducer in accordance with the invention will be described with reference to FIGS. 5 to 10.

Figure 5:
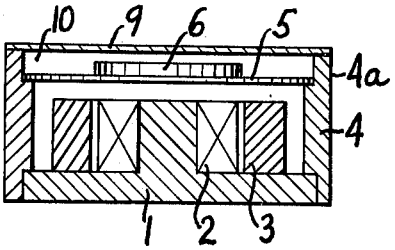
FIG. 5 is a schematic sectional view showing the structure of an essential portion of one embodiment of an electroacoustic transducer in accordance with the present invention for the purpose of describing the operation thereof.

FIG. 5 is a view for explaining the present invention and is a sectional view showing the structure of a mechanical vibration system having two degrees of freedom of mechanical vibration. The electroacoustic transducer shown in FIG. 5 comprises a magnetic core 1 with a center pole made of soft magnetic material, a coil 2 which surrounds the center pole of the core, a permanent magnet 3 which surrounds the coil 2 and a support 4 for a vibrating plate 5 having an armature 6 made of soft magnetic material secured to the vibrating plate 5 as in the electroacoustic transducer shown in FIG. 1. The electroacoustic transducer shown in FIG. 5 differs from that of FIG. 1 by the provision of a second vibrating plate 9 disposed opposite to the vibrating plate 5 and supported by an upwardly extending portion 4*a* of the support 4. The second vibrating plate 9 is coupled with the first vibrating plate 5 by an air spring comprising an airtight space 10 between the two vibrating plates.

Figure 6:
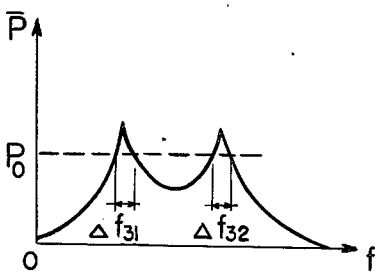
FIG. 6 is a curve showing the drive frequency characteristics of the structure shown in FIG. 5.

In the electroacoustic transducer shown in FIG. 5, when an alternating current is passed through the coil 2, the vibrating plate 5 with armature 6 is electromagnetically driven and vibration of the vibrating plate 5 is transmitted to the second vibrating plate 9 through the air spring comprising the airtight space 10. The acoustic pressure-drive frequency characteristics of the electroacoustic transducer of FIG. 5 has two resonance points as illustrated in FIG. 6.

The acoustic pressure-drive characteristic features of the electroacoustic transducer shown in FIG. 5 will be described with reference to FIGS. 7 and 8. The vibration system of the structure shown in FIG. 5 can be converted into an equivalent mechanical vibration system illustrated in FIG. 7. The reference characters M, K and $X_M$ respectively designate an equivalent mass, an equivalent spring constant and an amplitude of the first vibrating plate 5 with the armature 6. The characters "m," "k" and "$x_m$" respectively designate an equivalent mass, an equivalent spring constant and the amplitude of the second vibrating plate 9 in FIG. 5. The character ka designates the air-spring constant of the space 10 in FIG. 5. These factors are essential components of the vibration system and although attenuating resistance, acoustic impedance and so forth must actually be considered they are here omitted for the convenience of a simplified description.

The solution of forced vibration in case an alternating force $F\sin\omega t$ is applied to the mass M of such vibration system is indicated by the following equations:

$$XM = \frac{F}{M}\left[\frac{k+ka}{m} - \omega^2\right] / \left[\omega^4 - \left(\frac{k+ka}{M} + \frac{k+ka}{m}\right)\omega^2 + \frac{Kk+Kka+kka}{Mm}\right] \quad (1)$$

$$Xm = \frac{kaF}{Mm} / \left[\omega^4 - \frac{k+ka}{M} + \frac{k+ka}{m}\right)\omega^2 + \frac{Kk+Kka+kka}{Mm}\right] \quad (2)$$

Figure 8:
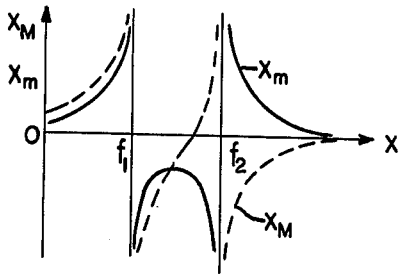
FIG. 8 shows curves illustrating the drive frequency characteristics of the structure shown in FIG. 7.

As will be understood from the above equations, two resonance points are produced as seen from the amplitude-drive frequency characteristics illustrated in FIG. 8.

It will be obvious to obtain the acoustic pressure in FIG. 6 taking note of the amplitude xm of the second vibrating plate 9 from FIG. 8. The resonance frequencies $f_1$ and $f_2$ shown in FIG. 8 can be made to approach one another by properly selecting the constants of the vibration system shown in FIG. 7 but they cannot be completely coincident unless the equivalent mass m becomes 0 (m=0). Hence, two resonance points are always produced.

The acoustic pressure is greater at the two resonance points of of such vibration system but only the frequency bands $\Delta f_{31}$ and $\Delta f_{32}$ as shown in FIG. 6 are normally useful and these bands are insufficient to attain the desired objectives. The essential point of the present invention is to compensate this by an acoustic effect in order sufficiently to broaden the frequency band as will be described with reference to FIGS. 9 and 10.

Figure 9:
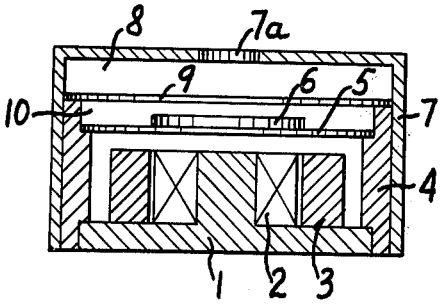
FIG. 9 is a schematic section of an electroacoustic transducer in accordance with the invention.

FIG. 9 is a schematic sectional view of the structure of an electroacoustic transducer in accordance with the present invention. The electroacoustic transducer shown in FIG. 9 is like that shown in FIG. 5 with the addition of an acoustic case 7 having a sound radiating port 7a and forming with the second vibrating plate 9 a chamber 8 comprising a Helmholtz resonator.

Figure 10:
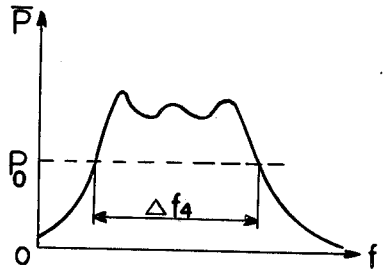
FIG. 10 is a curve showing the drive frequency characteristics of the transducer shown in FIG. 9.

When the resonant frequency of the Helmholtz resonator comprising the chamber 8 is provided intermediate the mechanical resonance frequency $f_1$ and $f_2$ of the second vibrating plate described with reference to FIG. 8 in the electroacoustic transducer of the structure described above, the acoustic pressure-drive frequency characteristics of the transducer become those shown in FIG. 10 so that the frequency band $\Delta f_4$ higher than a predetermined acoustic pressure Po becomes broad as illustrated in FIG. 10.

It will be apparent from the foregoing description that although the electro-to-mechanical conversion has been described with reference to an electromagnetic type transducer, the same effect can also be obtained by making use of other electric-to-mechanical transducers such as the piezoelectric type, dynamic type, etc.

Figure 7:
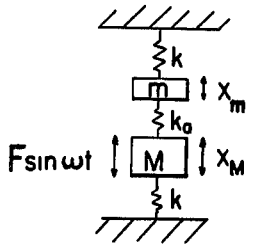
FIG. 7 is a schematic view showing the mechanical equivalent of a simplified vibration system in accordance with the invention.

There is heretofore one type of electroacoustic transducer provided with thin plastic film or the like bonded to the same position as that corresponding to the second vibrating plate 9 of the present invention for the purpose mainly of moisture resistance, dustproofing, etc. but this is clearly different from the object of the present invention and corresponds to the transducer in which the equivalent mass m of the second vibrating plate in FIG. 7 is almost 0 and does not achieve any broadening of the frequency band of the electroacoustic transducer.

It is to be noted that although the embodiment of the invention shown by way of example in the drawings utilizes a Helmholtz resonator, the present invention is not limited only to this but may be altered so long as there is provided a resonator having an air chamber including a sound radiating port.

It will be understood from the foregoing description that since the electroacoustic transducer constructed according to the present invention positively utilizes resonance in order to obtain a broad frequency band it may produce a variety of tone-colors with low power consumption in order to contribute to multi-functions of small-sized portable equipment such as wristwatches, pocket watches and remote paging units.

What is claimed is:

1. An electroacoustic transducer comprising a first vibrating plate, a second vibrating plate spaced from said first vibrating plate, an armature of soft magnetic material secured to the first only of said vibrating plates, electrically driven means acting magnetically on said armature for vibrating said first vibrating plate, means interconnecting peripheral portions of said first and second vibrating plates to provide between said plates an airtight space comprising an air-spring coupling said second vibrating plate with said first vibrating plate whereby vibration of said first vibrating plate is transmitted by said air-spring to said second vibrating plate, said first vibrating plate being driven by said electrically driven means and said second vibrating plate being driven by said air-spring, said first and second vibrating plates coupled by said air-spring comprising a vibration system having two resonant frequencies, and a resonant air chamber superposed on said second vibrating plate which forms a wall of said chamber, said resonant air chamber having a sound radiating port.

2. An electroacoustic transducer according to claim 1, in which said resonant air chamber has a resonant frequency between said resonant frequencies of said vibration system comprising said first and second vibrating plates coupled by said air-spring.

* * * * *